United States Patent [19]

Jones et al.

[11] 3,955,351

[45] May 11, 1976

[54] PRODUCTION OF BULKED YARNS

[75] Inventors: Clive Righton Jones; Michael John Rogerson, both of Pontypool, England

[73] Assignee: Imperial Chemical Industries Inc., London, England

[22] Filed: Dec. 2, 1971

[21] Appl. No.: 204,133

Related U.S. Application Data

[63] Continuation-in-part of Ser. No. 796,994, Feb. 6, 1969, abandoned.

[52] U.S. Cl. ..... 57/140 R; 57/157 S; 57/157 TS

[51] Int. Cl.[2] ..... D02G 1/02; D02G 3/24

[58] Field of Search ..... 57/34 HS, 157 TS, 157 S, 57/140 R

[56] References Cited

UNITED STATES PATENTS

| | | | |
|---|---|---|---|
| 3,022,565 | 2/1962 | Fitzgerald | 57/157 TS |
| 3,404,525 | 10/1968 | Tompkins | 57/140 R |

FOREIGN PATENTS OR APPLICATIONS

| | | | |
|---|---|---|---|
| 777,625 | 6/1957 | United Kingdom | 57/34 HS |

*Primary Examiner*—John Petrakes
*Attorney, Agent, or Firm*—Herbert M. Adrian, Jr.

[57] ABSTRACT

Yarn is simultaneously drawn and false twist crimped at a draw ratio below the standard draw ratio for the yarn when flat drawn, with the false twist passing through the draw necking portion of the yarn.

10 Claims, 1 Drawing Figure

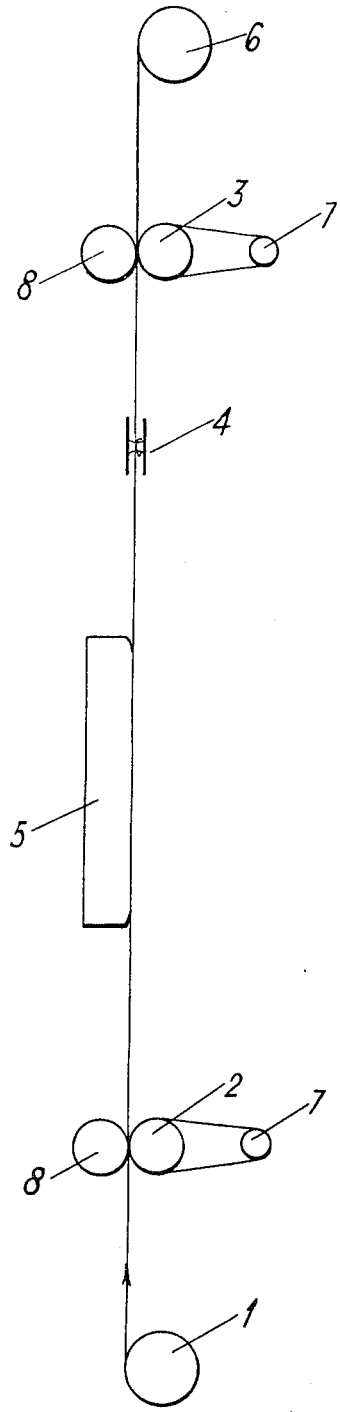
6
3
7
8
4
5
2
7
8
1

PRODUCTION OF BULKED YARNS

This application is a continuation-in-part application of Ser. No. 796,994, filed Feb. 6, 1969 now abandoned.

The invention concerns improvements in or relating to the production of bulked yarns, particularly such yarns in which the bulk is induced by the false twist crimping process.

Bulking by false twist crimping is now a well-established industry, with the majority of interest concentrated in polyamide and polyester multifilament yarns owing to the readiness with which these materials may be set in a desired deformed state.

Circumstances are such that in many instances the yarn producers make special feed-stock yarns for use in the sundry false twist crimping processes. For instance, in some cases it is desirable to employ as feed-stock a yarn which has not been fully drawn according to the conditions normally appertaining to yarn of its kind. At the other end of the false twist crimping process, the crimped yarn is often further processed in order to modify its bulk and stretch characteristics to fit the fabric or other use requirements for which the yarn is intended.

Thus, post-treatments are carried out, either continuously on the crimped yarn as it travels towards the wind-up on the crimping machine, or batch-wise after the yarn has been wound or skeined.

Whilst it has been previously proposed to combine the producer's step of drawing the feed-stock yarns, that is, to further orient the molecules of the filaments, and processor's step of false twist crimping, historical circumstances in the way the trade is fragmented have told against the establishment of such a combined process in practice.

It has now been found that very considerable and surprising process and product advantages arise when the particular posttreatment, involving a controlled amount of overfeed of the crimped yarn on to the take-up package of the false twist crimping machine, is provided with a feed-stock of synthetic polymer yarn in a drawable state, and the conditions of false twist crimping are such as to draw the yarn.

The main advantage, particularly in polyester yarns, is that of dyeing unifomity, compared with similar yarn produced from previously drawn yarn. It is possible, although the applicants do not wish to be bound by the theory, that this improvement is due to the lower rate at which drawing takes place when in the context of false twist crimping, and the concomitant increased time for heating the yarn, compared with ordinary drawing processes.

Subsidiary advantages are that of increased bulk for a given drawable feed stock, and that of the ability to produce a variety of different bulk effects from a common feed-stock by the simple expedient of altering the draw ratio applied between the feed rolls and draw rolls (take-out rolls) of the false twist crimping machine.

The invention therefore comprises a process for producing a bulked synthetic polymeric yarn by false twist crimping and by subsequent controlled longitudinal contraction of the crimped yarn prior to winding and heating in said controlled longitudinally-contracted state in which yarn feed-stock in a drawable state is fed via feed rolls to false-twist means and is withdrawn by take-out rolls so that the yarn is drawn at a neck located at the upstream end portion of a heater by which twist is set within the drawing and false twisting zone, the take-out rolls of said zone being rotated at a peripheral speed higher than that of the feed rolls of said zone by an amount equivalent to the desired draw ratio.

Thus, drawing takes place in or on the heater, e.g. within the first inch or two of contact with a conduction type of heater, with the yarn drawing at a visible neck at that point, the neck being so located by virtue of the heating-up of he drawable yarn.

In these circumstances, drawing takes place very uniformly and very completely, normally at draw ratios lower than standard for the yarn in question. No snubbing-pin need be used. Thus, in the absence of the snubbing pin, the yarn draws at a neck located on the heater and the twist (real twist at this point in the travel of the yarn, said twist being removed as the yarn travels through the false twist inserter) passes back through the draw point of the yarn to a twist dam (such as the feed rolls or a yarn guide) in accordance with conventional false twisting principles. The diameter of the yarn immediately before the draw necking segment thereof is that of the undrawn yarn while the diameter of the yarn immediately after the draw necking segment thereof is that of the drawn yarn. The ratio of undrawn yarn diameter to drawn yarn diameter is approximately equal to the numerical draw ratio employed, based on feed roll and draw roll peripheral speeds. As the twist passes back through the draw necking portion of the yarn, its frequency (turns per inch) progressively decreases approximately proportional to the increasing diameter of the yarn, reaching its lowest value in the undrawn yarn. For example, assuming 60 turns per inch (tpi) of false twist is being inserted into a traveling yarn as the yarn is being drawn at a 4:1 draw ratio, with the twist passing back into the undrawn yarn, the tpi decreases as it passes back through the draw necking segment of the yarn, reaching a level of about 15 tpi in the undrawn yarn. In the present process, substantially all of the drawing to which the yarn is subjected is accomplished as described above.

Normally, the feed rolls are unheated, but under some circumstances depending upon the final yarn characteristics that are desired, they may be heated.

The stabilizing process can be one involving heating the yarn on the run whilst it is travelling to the wind-up; or one involving heat treatment of the package as wound up, e.g. by steam, followed by, or combined with, dyeing, or one involving a combination of the above two heating proceses.

The yarn feed-stock can be provided in a drawable state either directly from a continous supply thereof, e.g., a meltspinning machine, or in the form of a wound package of drawable yarn which will be mounted on a creel in place of the conventional package of so-called "raw", or producer's yarn. i.e. yarn in a drawn state, but without any subsequent processing other than optionally a small amount of twist or intermingling to effect coherence.

The temperature to which the heater is heated will depend on the nature of the polymeric yarn, and on the process throughput; but in general it can be said that lower temperatures will be required, for a given throughput, and a given degree of bulk to be attained, then in the case of a like process utilizing a drawn yarn as feed-stock, provided that the lower draw ratio is employed.

Preferably, the drawn yarn is allowed to contract by at least 10% between the take-out rolls and the wind-up means.

The invention has found its main application to date in the production of bulked yarns of synthetic linear polyesters, such as polyethylene terephthalate, owing chiefly to the commercial emphasis on the use of this polymeric yarn in bulked yarns of the kind in question. However, it may be useful in the production of bulked yarns of other polymeric material, as for instance, synthetic linear polyamide, for example, nylon 6 and nylon 66.

The invention will now be described by reference to some exemplary processes utilizing drawable multifilament yarn of polyethylene terephthalate, having an as-spun total denier of 540 and 30 filaments.

EXAMPLE 1

The drawable yarn was drawn and false twist crimped on a machine calculated to insert 55 turns per inch S twist by a false twist head rotating at 300,000 rpm, and having a 2 foot long tracked, convex conact-heater. Drawing took place at a neck at the start (i.e. upstream end) of the heater, the draw ratio having been set by fixing the speed ratio of the feed and the draw rolls (take-out rolls) of the machine. The crimped yarn was positively forwarded to a cheese-type wind-up, the traverse guide of which was so adjusted in reciprocating rate during the wind that a constant wind ratio was maintained in winding a soft yarn package. The yarn linear speed at the draw rolls was 230 feet per minute, and wind-up was at 195 feet per minute, corresponding to a mechanical overfeed (i.e. overfeed set on the machine, as between the draw roll and the wind-up package) of 15%. In these conditions, the amount of linear contraction of the crimped yarn was 11%. The yarn package was steamed for 20 minutes at 25 psi; and subsequently this yarn was coned, with the application of an oil, and then knitted as two-fold in 24 gauge fully-fashioned panels for comparison with "control" yarns which had been processed commercially, using drawn 150 denier/30 filament polyethylene terephthalate yarn as feed-stock.

Various heater temperatures between 140°C and 200°C were utilized in successive trials, to assess the effect of heater temperature on final fabric appearance; and, similarly, different draw ratios, between 2.9 and 3.65 (the "standard" draw ratio for this yarn) were tried.

It was established that the yarns according to the invention provided greater fabric bulk than those of the "control"; and that fabric bulk decreased with reduction in processing temperature and increase in draw ratio. In fact, at the standard draw ratio of 3.65, acceptable fabric bulk and handle were only attainable at 180°C heater temperature; and consequently such a high draw ratio is not normally desirable, and neither is it desirable on the score of rather excessive filamentation that takes place. In fact, in practicing the simultaneous draw, false twist process as described herein, it is believed essential to draw the yarn (based on feed and draw roll speeds) at a draw ratio below the standard draw ratio used for the yarn in order to produce a product commercially useable for knit and woven fabric applications of the type in which false twist textured continuous filament yarns are employed. By standard draw ratio as used herein is meant the highest draw ratio at which the flat undrawn (as-spun) yarn can be drawn without breaking filaments forming the yarn bundle. The standard draw ratio is experimentally determined by drawing a given yarn (as-spun) at a variety of draw ratios and packaging 1.5 pounds of drawn yarn in straight side or biconical package form. Three packages are produced. The entire visible surface of packaged yarn is then viewed under adequate light to visually see any broken filaments on the surface of the package. If at least one broken filament is observed on two out of the three yarn packages, the yarn has been drawn at a draw ratio above its standard draw ratio. Draw ratio is lowered until the two packages pass the test. Draw ratio is determined to the closest hundreth. The standard draw ratio is usually the draw ratio which produces the best tensile properties, particularly tenacity, in the yarn as compared with all lower draw ratios used for the same yarn. Tensile factor ($te^{1/2}$ wherein $t$ is tenacity and $e$ is elongation) can be used as a numerical measurement of the tensile characteristic of a yarn. As used herein, standard draw ratio has reference to the drawing of the yarn, which yarn has not been subjected to a previous drawing operation except insofar as "drawdown" between the spinnerette and spinning machine take-up (or initial speed control devices in a spin-draw operation can be considered as yarn "drawing") with the yarn in an essentially straight configuration, known in the art as "flat yarn drawing".

The false twist textured yarn produced in accordance with the "below standard draw ratio — simultaneous draw, false twist texturing process" is different than an identical precursor yarn which has been flat drawn at any draw ratio and then false twist textured, or has been subjected to the type of simultaneous draw-false twisting described herein at the standard draw ratio. It is difficult for the artisan to numerically express these differences in a meaningful manner using the routine analytical tools at his disposal.

EXAMPLE II

Comparison of fabric dyeing properties was made between bulked yarns produced according to the invention and those produced in the present conventional manner from drawn yarn feed-stock. Both sets of yarns were derived from the same spinning batch.

The respective processing conditions were as follows:

| Condition | Process according to the invention | Conventional process |
|---|---|---|
| Spindle speed | 150,000 rpm | 150,000 rpm |
| Twist | 55 tpi | 55 tpi |
| Heater Temperature | 185°C | 193°C |
| Mechanical (set) overfeed | 13.5% | 15% |
| Draw Ratio | 3.2 | — |
| Overfeed to twist zone | — | 0% |

Both sets of yarns were steam set on the wind-up packages for 20 minutes at 27 psi.

After coning, the respective yarns were knitted into panels and into circular fabrics (12 feeder), which were dyed, at 100°C, Cypress Green and were then visually compared for dyeing uniformity. It was found by assessment of the panels that the bulked yarn according to the invention evidenced no short-term dyeing variations due to within-package variability, which were present in the conventional yarn; and far less between-package variations. Also, in the assessment of the circular fabrics, it was found that stripiness and short-term variations were markedly less for the yarn of the invention than for the conventional yarn.

A suitable apparatus for carrying out the invention will now be described.

The apparatus is diagrammatically illustrated in the accompanying drawing and comprises a positive-feed false twist crimping machine having a supply package creel 1, a feed roll 2 (of light inertia) and a draw roll 3 both driven from a single motor through chains and sprockets via a Kopp variator (not shown) by means of which the relative speeds of the rolls (and hence the set draw ratio) can readily be changed, a magnetically-mounted twist-head four belt-driven by a motor and Kopp variator (now shown), capable of prolonged running at 300,000 rpm, a twintrack 2 foot contact heater 5 having its temperature controlled by a proportional controller (not shown) and conventional yarn wind-up means 6. Yarn passes through the machine from bottom to top thereof.

Both the feed and draw rolls are provided with separator rolls 7 (i.e. rolls closely aligned to the main rolls and adapted to keep separate a plurality of yarn wraps taken around both rolls together), and with nip rolls 8 on weighted arms (not shown), which latter are lowered on to the draw roll and feed roll, respectively in that order, at start-up.

Swing-arm thread-guide means are also provided by means of which the threadline can be either held in contact with the heater track along its length or held in closely spaced relationship thereto.

The reason for this is that it is important with certain polymeric materials, as for instance polyethylene terephthalate, that the yarn should not make contact with the heater (at full processing temperature) until the process is running correctly, i.e. until drawing and twisting are taking place. On the other hand, drawing will not take place correctly unless the yarn is heated to a moderate temperature.

This matter is high-lighted by polyester yarns (in contradistinction, say, to polyamide yarns) which will yield and rupture too readily if heated under tension in the drawable state above their second order transition temperature (90°C–100°C). The above technique affords the possibility of starting-up the process for such yarns with the threadline close to the heater, so that the drawable yarn may be moderately heated by radiation therefrom; and, as soon as drawing is observed to be occurring, which will be almost immediately, the threadline may then be transferred to make contact with the heater, the first part of which (desirably the bottom) being at a lower temperature than the main part due to heat losses. It has been found that the threadline should not be closer than ¼ inch from the heater during start-up, or else melting of the drawable polyethylene terephthalate may still occur.

Similarly, if the post-treatment of the crimped yarn is to be a continuous one performed by heating the yarn under controlled conditions of contraction prior to wind-up, the heater for this purpose will be provided with means for holding the threadline out of contact with the heating means, e.g. a similar tracked contact heater, until drawn, crimped yarn is being produced.

What is claimed is:

1. A continuous process to produce false twist crimped polyester yarn without excessive filamentation which comprises feeding a drawable polyester yarn into a yarn false twist crimp inducement zone bounded by yarn feeding means and yarn drawing means, forwarding said drawable yarn from said feed means while still in said drawable state to a heated segment of said zone and heating said yarn to a temperature at which it draws in said heated zone while simultaneously inserting false twist into said yarn by means of a false twist device and setting the false twist into said yarn in said heated zone; allowing said false twist to pass upstream through the draw necking portion of said yarn in said heated zone while accomplishing the total desired draw of said yarn in said heated zone at said yarn draw necking portion, the frequency of said false twist being reduced about proportional to the increasing diameter of the yarn through which it passes; drawing said yarn in said crimp inducement zone at a desired draw ratio below the "standard" draw ratio for said yarn when drawn in the flat yarn state, and contracting said yarn longitudinally after leaving said false twist crimp inducement zone.

2. The process of claim 1 wherein the heated segment of said zone is a yarn contact conduction heater over which said yarn passes.

3. The process of claim 1 wherein said yarn is heated while being contracted.

4. The yarn produced by the process of claim 3.

5. The process of claim 1 wherein said yarn is heated after being wound on a package to effect said longitudinal contraction.

6. The yarn produced by the process of claim 5.

7. The process of claim 1 wherein said yarn is contracted at least 10%.

8. The process of claim 1 wherein the yarn comprises polyethylene terephalate.

9. The process of claim 1 wherein the yarn is intermingled prior to being false twist crimped.

10. The yarn produced by the process of claim 1.

* * * * *